US006203077B1

(12) United States Patent
Schlack

(10) Patent No.: US 6,203,077 B1
(45) Date of Patent: Mar. 20, 2001

(54) OVER-CENTER TOGGLE LATCH WITH INTEGRAL SAFETY SWITCH

(75) Inventor: Richard E. Schlack, Rising Sun, MD (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/153,106

(22) Filed: Sep. 15, 1998

Related U.S. Application Data

(60) Provisional application No. 60/062,139, filed on Oct. 3, 1997.

(51) Int. Cl.[7] ..... E05C 3/04

(52) U.S. Cl. ..... 292/203; 292/99; 292/341.17; 292/DIG. 49

(58) Field of Search ..... 292/197, 341.15, 292/341.17, 99, 102, 203, DIG. 49, DIG. 46; 70/432, 434

(56) References Cited

U.S. PATENT DOCUMENTS

| | | | | |
|---|---|---|---|---|
| 3,638,457 | | 2/1972 | Filipak | 68/12 R |
| 3,841,677 | | 10/1974 | Guth | 292/335 |
| 4,298,223 | | 11/1981 | Raffelsiefer et al. | 292/216 |
| 4,351,288 | | 9/1982 | Gasloil | 126/197 |
| 4,465,997 | | 8/1984 | Hines | 340/542 |
| 4,613,176 | | 9/1986 | Kelly | 292/201 |
| 4,655,489 | | 4/1987 | Bibhing | 292/110 |
| 4,664,430 | | 5/1987 | Bernard | 292/201 |
| 4,687,237 | | 8/1987 | Bishing | 292/78 |
| 4,745,250 | | 5/1988 | Mayo | 219/10.55 |
| 5,062,670 | * | 11/1991 | Grossman | 292/137 |
| 5,125,700 | * | 6/1992 | Fattori et al. | 292/218 |
| 5,580,182 | * | 12/1996 | Lin | 403/325 |
| 5,628,148 | * | 5/1997 | Beutler | 49/394 |
| 5,639,270 | | 6/1997 | Barbieri et al. | 439/849 |
| 5,879,036 | * | 3/1999 | Moline et al. | 292/210 |

FOREIGN PATENT DOCUMENTS

| | | | |
|---|---|---|---|
| 2 134 963 | 8/1984 | (DE) | E05B/55/12 |
| 3301626 A1 | 7/1994 | (DE) . | |
| 2 133 455 | 7/1984 | (GB) . | |

OTHER PUBLICATIONS

Southco, Inc., Latches and Access Hardware, North American, Edition–47NA, pp. G1–G4, Concordville, PA.

Scientific Technologies, Inc., STI/Guardmster catalog, Hayward, CA.

K.A. Schmersal GMBH & Co., Schmersal Industrial Switchgear catalog.*

K.A. Schmersal GMBH & Co., Schmersal Industriaeschalt-Gerate catalog, German language. See English language catalog above for similar products.*

Schmersal World Wide Web pages, 1998.*

Guardmaster Ltd., Guardmaster Safety Switches, Lancashire, England, Pub. No. 428C.*

* cited by examiner

*Primary Examiner*—B. Dayoan
*Assistant Examiner*—Clifford B Vaterlaus
(74) *Attorney, Agent, or Firm*—Paul & Paul

(57) ABSTRACT

An over-center toggle latch for securing two members together having a latch housing affixed to one of the members, a keeper affixed to the other of the members, a toggle pivotally mounted within the housing for pivotal movement between a first position and a second position, and a retainer disposed within the housing and in pivotal contact with each of the housing and the toggle for retaining the toggle in either of the first and second positions. The keeper pivots the toggle from the first position to the second position upon the closing of the latch and the keeper pivots the toggle from the second position to the first position upon the opening of the latch. A switch operable between a closed position and an open position wherein a circuit is closed only when the keeper means is in the second position and the circuit is open only when the keeper is in the first position, the switch being completely inoperable until the keeper is fully inserted in the housing whereby closing of the circuit is avoided.

6 Claims, 7 Drawing Sheets

OVER-CENTER TOGGLE LATCH WITH INTEGRAL SAFETY SWITCH

REFERENCE TO RELATED APPLICATION

This application claims the benefit of U.S. Provisional Application No. 60/062,139, filed Oct. 3, 1997.

BACKGROUND OF THE INVENTION

This invention relates generally to latches and more specifically to latches of the over-center toggle type.

Over-center toggle latches are generally known in the art. For example, see U.S. Pat. No. 4,687,237, the complete specification of which is incorporated herein by reference, this invention being an improvement thereof. These known latches do not contain integral switches that provide an electronic signal for indication and actuation when the door or other panel cover and cabinet to which this latch is mounted is opened or closed, that is fool-proof, such that the latch keeper and therefore the door must actually be closed for current to flow through the switch. Integrating such a fool-proof switch into a latch has not until now been accomplished.

It would be advantageous to provide an over-center toggle latch with such an integral switch. The switch preferably has the capability to directly cut off a significant amount of current, e.g., for use as a safety switch for the main power to a electrical components in an enclosure to which this latch is attached.

SUMMARY OF THE INVENTION

This invention relates to an over-center toggle latch of the type where a door can be held closed at a predetermined, specific force. Additionally, the over-center toggle latch contains an integral switch. This integral, high power capacity, safety cutoff switch is provided, integral to the latch, that is preferably capable of handling relatively high currents, e.g. to cut off the power into an enclosure to which the switch is attached by, e.g., severing the main power line into the enclosure. Since the switch is integral with the latch, advantageously, no critical alignment of separate switches mounted on a door or panel, with respect to the fixed surface to which the door or panel is attached, is required. Moreover, it is not possible to close the contacts on the switch without the keeper being in position with the latch closed. By merely snapping the latch closed without the keeper in place, current does not flow through the switch. The keeper must be properly positioned within the latch and the latch must be in the closed position for current to flow through the switch. This is possible only because current must flow through a circuitous path through the conductor within the keeper itself.

The over-center toggle latch with integral safety switch of the present invention comprises a latch for securing two members together, the latch having a latch housing affixed to one of the members and a keeper having a projecting member affixed to the other of the members.

Inside the housing is a toggle, mounted within the housing for pivotal movement between a first position and a second position. In the second position, the projecting member of the keeper is retained within the housing. In the first position, the projecting member of the keeper is released from the housing. A retaining means disposed within the housing is in pivotal contact with the housing and the toggle for retaining the toggle in either of the first or second positions.

A switch operable between a closed position and an open position is provided where a circuit is closed only when the keeper is in the second position and the circuit is open only when the keeper is in the first position. The switch is inoperable until the keeper means is fully inserted in the housing.

The electrical circuit switch has two contact leads integral to the latch housing at upper and lower ends thereof and a conductor that is in the keeper. The switch is switched off when the door to which the latch is attached is opened since the conductor in the keeper is necessary to make a complete circuit.

While it is anticipated that this switch be used in the manner set forth above, this switch may be used for any purpose where, in an electrical circuit, it is desired that information be provided as to the status of a cabinet door being opened or closed.

It is therefore an object of the present invention to provide an over-center toggle latch having an integral safety switch capable of handling relatively high current.

It is another object of the present invention to provide an over-center toggle latch having an integral safety switch where the switch will only provide electrical connection when the latch is in a closed position.

It is still another object of the present invention to provide an over-center toggle latch having an integral safety switch that provides an extremely reliable switch.

Other objects and advantages of the present invention will become apparent from the following description taken in conjunction with the accompanying drawings.

DESCRIPTION OF THE PREFERRED EMBODIMENT

Figure 2:
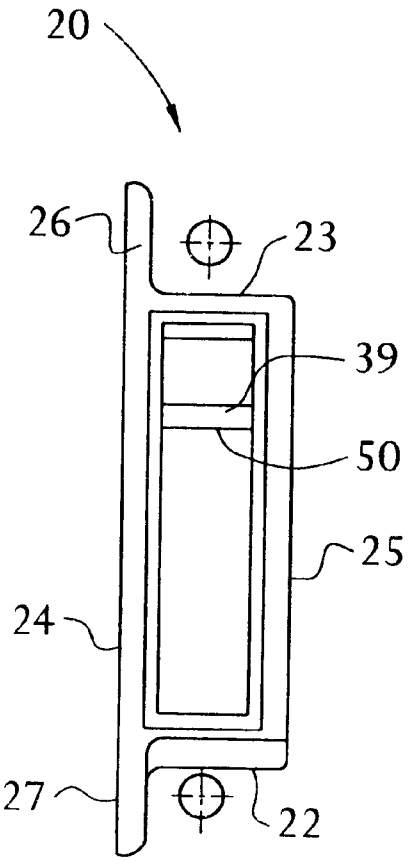
FIG. 2 is a side view of a latch housing as used on the latch of FIG. 1.
Figure 1:
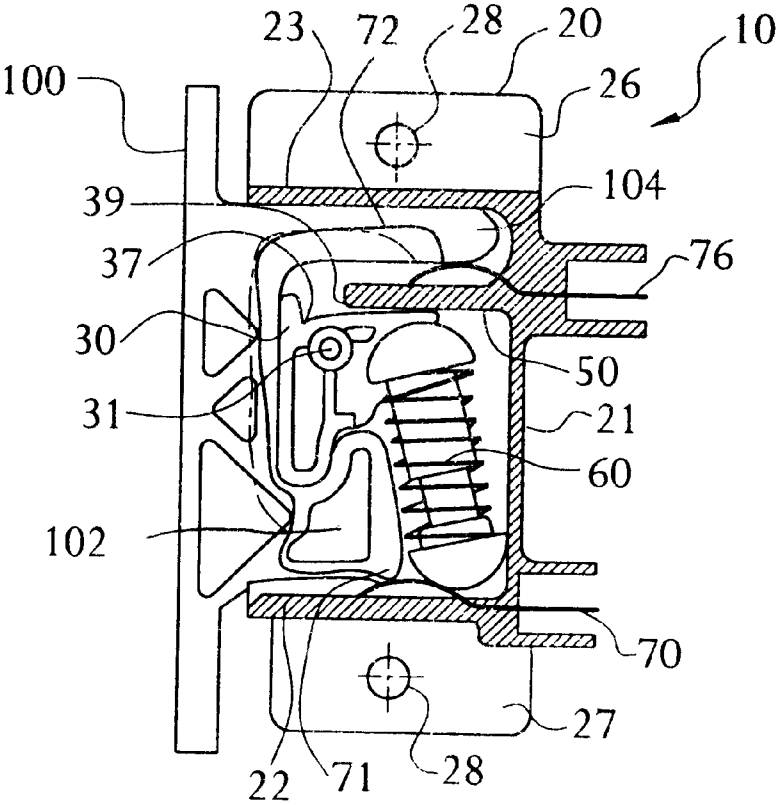
FIG. 1 is a front view of one embodiment of an over-center toggle latch with an electric current cut-off switch, with the latch in a closed position, partially broken away to show detail.
Figure 3:
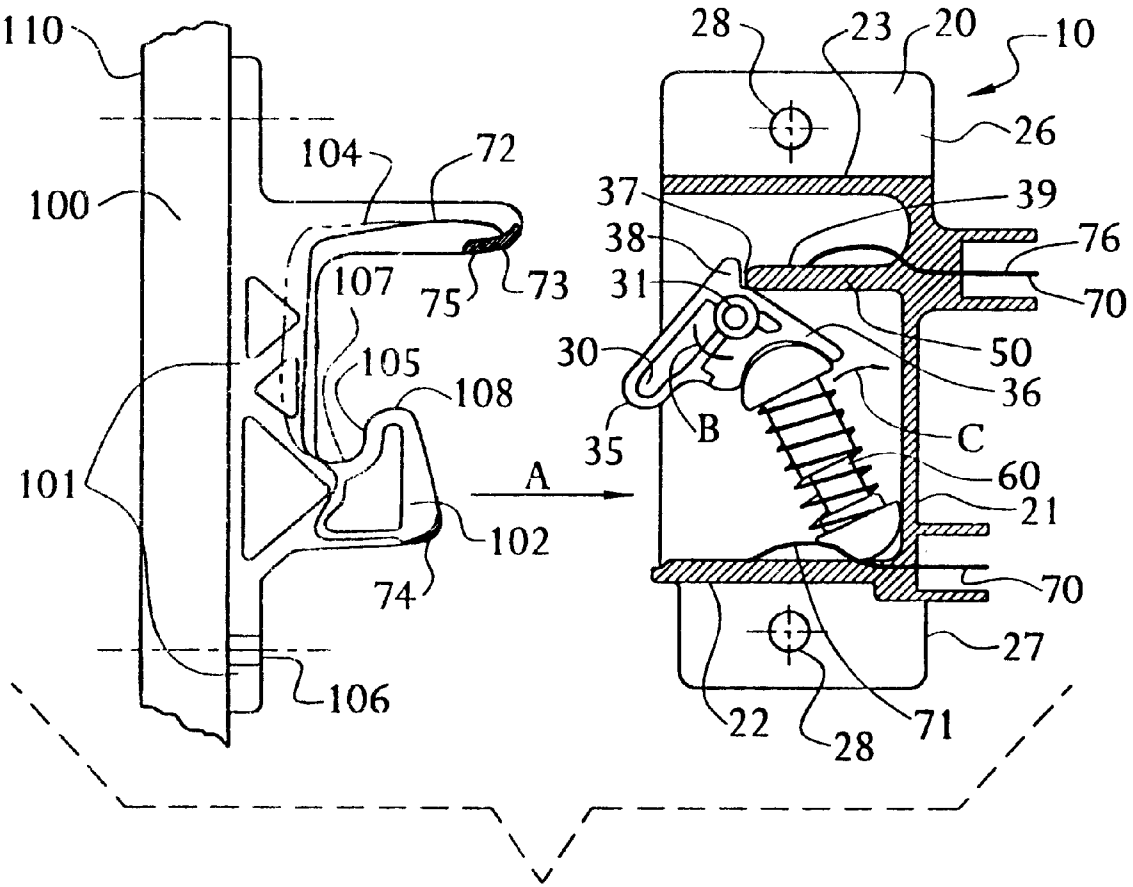
FIG. 3 is a front view of the over-center toggle latch with an electric current cut-off switch of FIG. 1, with the latch in an opened position, partially broken away to show detail.
Figure 9:
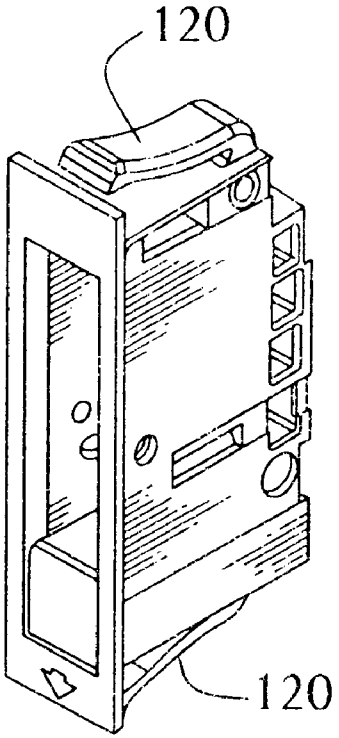
FIG. 9 is a perspective view of a housing for use on the latch of FIG. 6.
Figure 12:
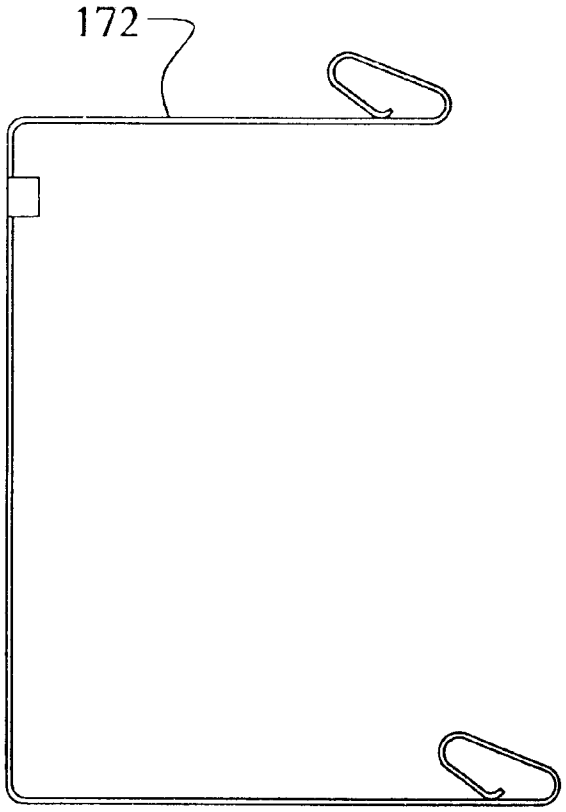
FIG. 12 is a perspective view of the conductor of FIG. 11.
Figure 11:
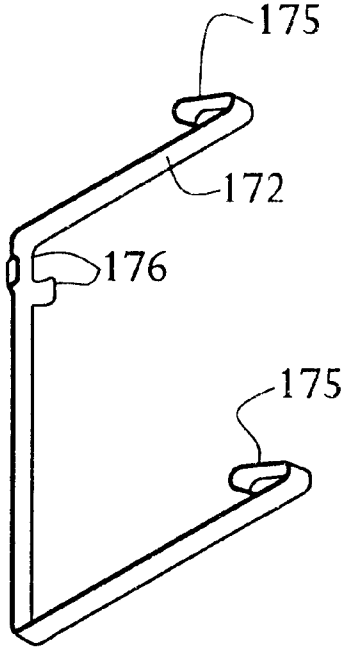
FIG. 11 is a perspective view of a conductor as used in a keeper of the latch of FIG. 6.

Referring now in detail to the drawings, wherein like reference numerals indicate like elements throughout the several views, there is shown in FIGS. 1 and 3 an over-center toggle latch 10 of the present invention, with an integral electrical current cut-off switch 70 in accordance with one preferred embodiment of the present invention. The over-center toggle latch 10 of the present invention generally comprises a housing 20 having a back wall 21 and side walls 22, 23. The housing 20 is also provided with bottom wall 24 and top wall 25 (see FIG. 2). Projecting from the side walls 22, 23 are mounting flanges 26, 27 which are provided with mounting openings, such as apertures 28 for facilitating the mounting of the housing 20 to a door-receiving structure (not shown). Other mounting means as known in the art may also be used, for example, the snap in mounting means 126, 127 of the alternate embodiment shown in FIGS. 6 and 9.

Figure 4:
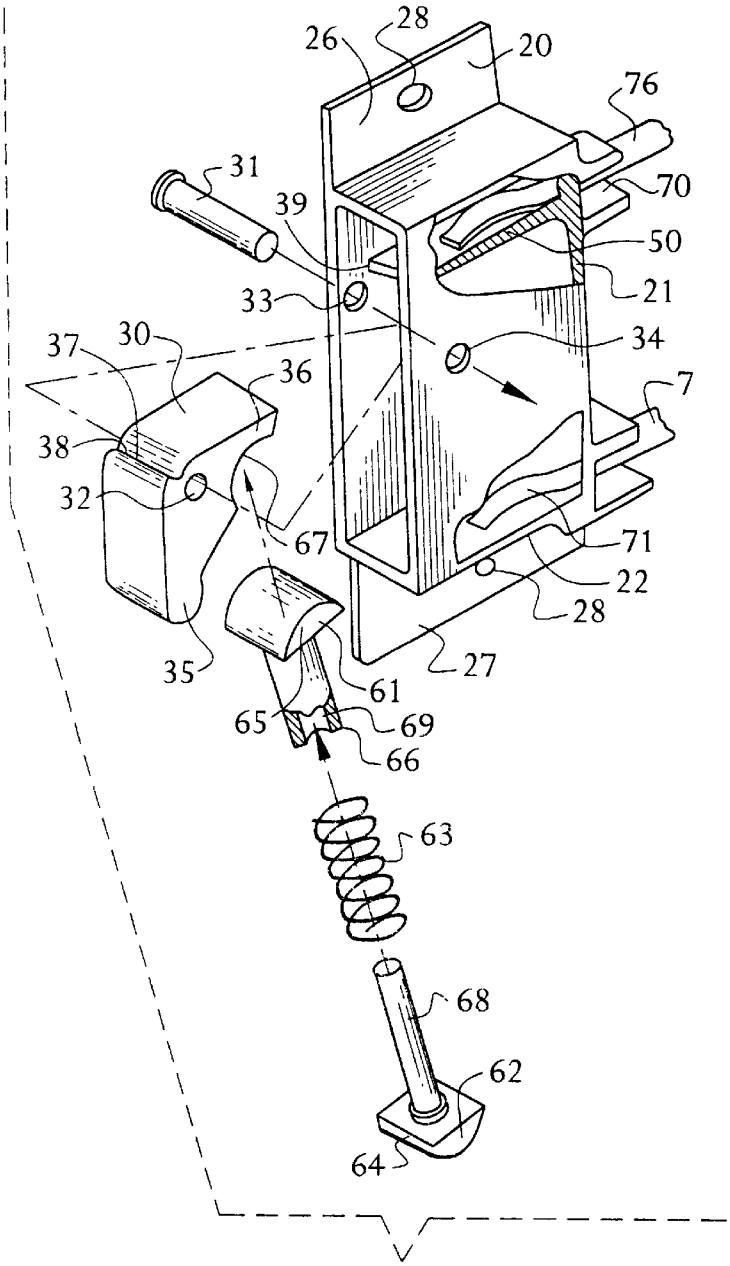
FIG. 4 is an exploded, perspective view, partially broken away, of the latch of FIG. 1.

Toggle member 30 is pivotally mounted within housing 20 by pivot pin 31 which extends through an aperture 32 in toggle member 30 and apertures 33, 34 in bottom and top walls 24, 25 of housing 20 (See FIG. 4). The pivotal movement of toggle member 30 about pin 31 is best seen in FIG. 1 (latch closed) and FIG. 3 (latch opened).

As seen in FIGS. 1, 3, and 4, toggle member 30 is an irregular-shaped member having a latch projection 35 and a leg 36 extending at generally right angles to one another from the aperture 32. Leg 36 is provided with a concave portion on its interior surface, the function of which will be described more fully hereinafter. Toggle member 30 is notched on its external surface as at 37 to form ear projection 38 which cooperates with shoulder 39 of middle wall of housing 50 and functions as a stop in the pivotal movement of the toggle member 30 when the toggle member is in the open, unlatched position (See FIG. 3).

Retaining means 60 is also provided within housing 20 to retain the toggle member 30 in the opened or closed positions, as illustrated in FIGS. 3 and 1, respectively. The retaining means 60 comprises a pair of guide members 61, 62 and a spring 63 (see FIG. 4). Guide member 61 comprises a head portion 65 and a sleeve portion 66, which head portion 65 has a convex surface adapted to be received in concave portion 67 of leg 36 of toggle member 30.

As can be seen in FIGS. 1 and 3 and in detail in FIG. 4, guide member 62 comprises a head portion 64 and a rod portion 68, which head portion 64 is also provided with a convex surface adapted to be received in the corner formed by side wall 22 and back wall 21 of housing 20. Sleeve portion 66 of guide member 61 is provided with bore 69 sized to closely receive rod portion 68 of guide member 62 for sliding telescopic engagement therewith. Spring 63 is sized so as to be received between head portions 64, 65 of guide members 61, 62 when rod portion 68 is positioned within bore 69 of sleeve portion 66, and urges head portions 64, 65 apart when positioned within housing 20.

Figure 5:
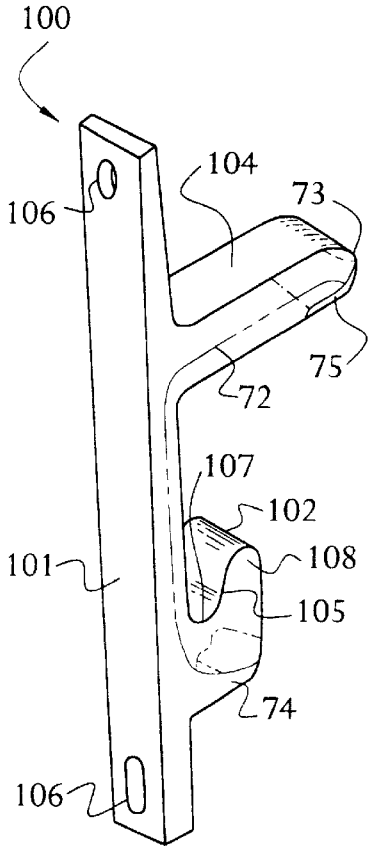
FIG. 5 is a perspective view of one embodiment of the latch keeper in accordance with the invention.

Referring now to FIGS. 1, 3, and 5, illustrated therein is keeper 100 having a base portion 101 with a dog projection 102, and a protruding male member 104, extending therefrom. Base portion 101 is provided with mounting apertures, such as holes 106 to facilitate the mounting of keeper 100 on a door 109. As seen in FIG. 5, dog projection 102 is generally "L"-shaped and extends outwardly and then upwardly from base portion 101 of keeper 100. The shape of dog projection 102 is such as to form an "S"-shaped inner surface 105 having a convex portion 108 and a concave portion 107 (see FIG. 3), which concave portion 107 is adapted to receive latch projection 35 of toggle member 30 when toggle member 30 is in the closed position as in FIG. 1, so that latch projection 35 overlaps convex portion 108 of dog projection 102 when the toggle member 30 is in the closed position.

The operation of the over-center toggle latch of the present invention will now be described more fully with reference to FIGS. 1 and 3. As illustrated in FIG. 3, the latch housing 20 is mounted on a door receiving structure, such as cabinet, by screws or other conventional means, through slots or holes 28 in flanges 26, 27. Keeper 100 may be attached to door 109 such as by screws extending through the mounting slots holes (See FIG. 3) of base portion 101 and connected to a door handle.

From the open, unlatched position illustrated in FIG. 3, door 109 is moved toward a cabinet to which housing 20 is attached, in the direction of arrow A until keeper base 101 comes in contact with latch projection 35 of the toggle member 30 which, in the opened position, is extending from the housing 20, as shown. Further movement of door 109 toward the cabinet, in the direction of arrow A, causes toggle member 30 to pivot in the direction of arrow B, which in turn, causes retaining means 60 to pivot in the direction of arrow C, whereby the toggle member 30 is snapped into the closed, latched position illustrated in FIG. 1.

As can be seen in FIG. 1, when the toggle member has snapped into the closed position, latch projection 35 nests within concave portion 107 and overlaps convex portion 108 of dog projection 102 whereby door 109 is held tightly closed.

Also illustrated in the Figures is the function of retaining means 60. As seen in FIG. 3, when the toggle member is in the open, unlatched position, convex surfaces of head portions 65, 64 of guide members 61, 62 respectively, are urged apart by spring 63 to exert pressure on concave surface 67 of leg 36 (see FIG. 4) and the corner of housing 20 formed by back wall 21 and side wall 22 (see FIG. 3) which, in turn, serves to retain toggle member 30 in the opened position (see also FIG. 1). When in the closed, latched position, as illustrated in FIG. 1, toggle member 30 is retained therein, again by the outwardly force generated by spring 60 on head portions 65, 64 of guide members 61, 62 respectively (see also FIG. 3).

As can be seen from the above-described function of the latch, the force by which the door is held against the surface of the receiving structure is a function of the compressive strength of the spring. Thus, the force by which the door is held closed can be readily altered, if desired, by substitution of springs having different compressive properties.

An integral safety cut-off switch is included as an element of the present over-center toggle latch. This current cut-off switch 70 provides the ability to handle a relatively large amount of current, such that, when the latch is unlatched, i.e. the keeper 100 is withdrawn from the housing 20, current to any electric or electronic devices within the enclosure to which the latch is attached is cut off.

The current cut-off switch 70 operates such that an unbroken circuit is created from contact 71 to a conductor 72 within keeper 100 that connects the lower edge of dog projection 102 to the tip 73 of protruding male member 104 of keeper 100 that connects to a second contact 76 at the upper end of housing 20 when the switch is closed, i.e. when the door is in the closed position and the latch is latched. At tip 73 of protruding male member 104 and at the lower edge of dog projection 102 are contact points 74, 75 that are positioned such that when the latch 10 is in the closed position, protruding male member 104 is inserted into the latch housing and a complete circuit is made. However, when the latch 10 is in the opened position as shown in FIG. 3, contacts 71, 76 disengage from contacts 74 and 75 such that any current flowing through the circuit is stopped due to the broken circuit. The contacts are made from a suitable conductor that provides required properties, including high conductivity, high resistance to corrosion and the like, as is known in art.

The safety cutoff switch 70 of the present invention provides several significant advantages. Since relatively heavy gauge contacts 71, 76 and conductor 72 may be used, a significant amount of current is capable of flowing through the latch. Moreover, the latch acts as a positive safety cut off. There is essentially no way of accidentally letting electricity flow through the switch, short of a deliberate act by a user.

Figure 6:
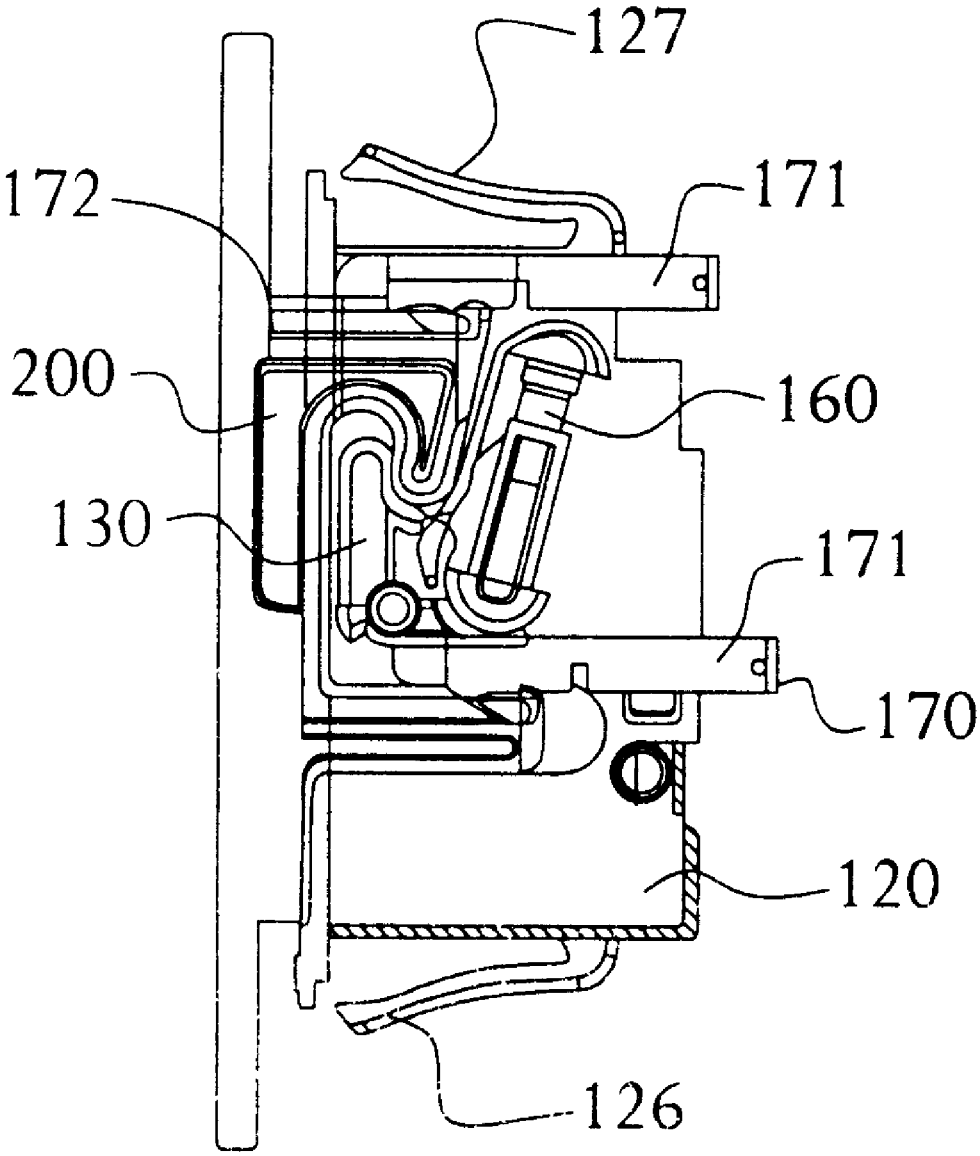
FIG. 6. is a front, partially broken away view of an alternate embodiment of the latch of FIG. 1.
Figure 8:
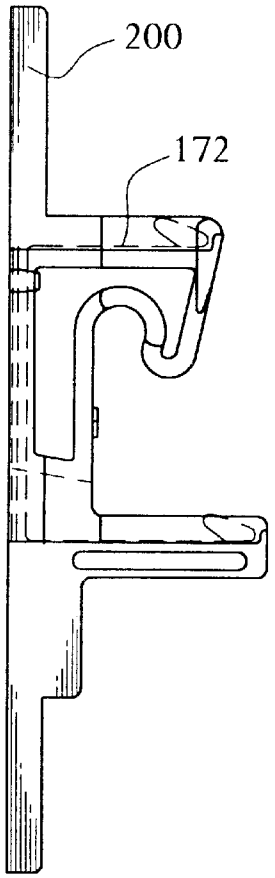
FIG. 8 is a front view of the keeper of FIG. 6 depicting an alternate conductor within the keeper.
Figure 7:
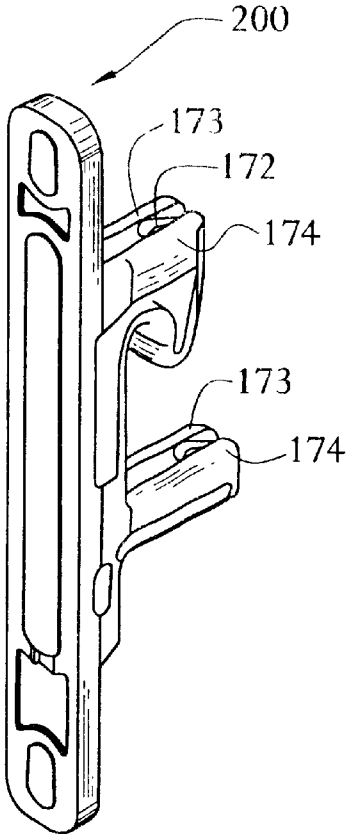
FIG. 7 is a perspective view of a keeper for use on the latch of FIG. 6.
Figure 10:
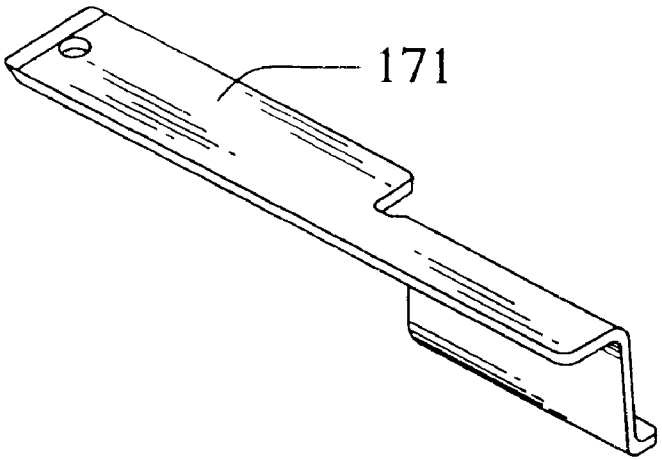
FIG. 10 is a perspective view of a contact as used in the housing of FIG. 6.

FIG. 6 depicts an alternate embodiment of the present invention 110 where FIGS. 7–12 depict the various detail parts of this embodiment. Here, the basic elements, including a housing 120 (see FIG. 9), toggle member 130, retaining means 160, keeper 200 and cut-off switch 170 are as in the first embodiment. A one-piece conductor 172 is provided here, as shown in FIG. 6 and detailed in FIGS. 11 and 12. The keeper has two specially designed wings 173, 174 on each side of the ends of the conductor 172 to ensure proper mating with contacts 171. A detail of contacts 171 is shown in FIG. 10. Contacts 172 are nested into supporting material in the housing 120 and are rigidly held in place. Cantilever contact ends provided proper resilience such that positive contact is always made between the conductor 172 in the keeper 200 and the contacts 171 in the housing.

The housing 200 this embodiment is shown with snap-in style mounting means 120. Optionally, other mounting means, such as that shown with the first embodiment may be used.

It will be recognized by those skilled in the art that changes may be made in the above described embodiments of the invention without departing from the broad inventive concepts thereof. It is understood, therefore, that this invention is not limited to the particular embodiments disclosed, but is intended to cover all modifications which are within the scope and spirit of the invention as defined by the appended claims.

What is claimed is:

1. An over-center toggle latch for securing two members together, said latch comprising:

(a) a latch housing adapted for being affixed to one of the members;

(b) a keeper means affixed to the other of the members;

(c) a toggle means, pivotally mounted within said housing for pivotal movement between a first position and a second position;

(d) retaining means disposed within said housing and in pivotal contact with each of said housing and said toggle means for retaining said toggle means in either of said first and second positions;

(e) said keeper means comprises means for pivoting said toggle means from said first position to said second position upon the closing of said latch;

(f) said keeper means comprises means for pivoting said toggle means from said second position to said first position upon the opening of said latch; and (g) a switch operable between a closed position and an open position wherein a circuit is closed only when said toggle means is in said second position and the circuit is open only when said toggle means is in said first position, said switch being open until said keeper means is fully inserted in said housing;

whereby the latch contains the switch requiring the latch to be in the latched position to complete the circuit such that accidental closing of the circuit is avoided.

2. The over-center toggle latch of claim 1, wherein the switch has a conductor extending through a portion of the keeper that mates with contacts in the housing to close the switch circuit.

3. An over-center toggle latch for securing two members together, said latch comprising:

(h) a latch housing adapted for being affixed to one of the members;

(i) a keeper having a base portion adapted for being affixed to the other of the members, having a dog projection connected to said base portion and extending therefrom, said dog projection adapted for being received within said housing and retained therein when the latch is in a closed position and released when the latch is in an opened position;

(c) a toggle member, pivotally mounted within said housing for pivotal movement between a first position, to receive said dog projection, and a second position in overlying disposition to said dog projection and in sandwich orientation to said base portion and said dog projection, whereby said dog projection is retained within said housing;

(d) retaining means disposed within said housing and in pivotal contact with each of said housing and said toggle member for retaining said toggle member in said first and second positions, said retaining means comprising a first guide member and a second guide member in telescopic relation to said first guide member, said first guide member having a body portion and a head portion, said head portion having a generally convex outer surface in pivotal sliding engagement with a generally concave surface on said toggle member, said second guide member having a body portion and a head portion, said head portion having of said second guide member having a generally convex outer surface in pivotal sliding contact with an inner wall of said housing, and a coil spring disposed about said body portions of said first guide member and contacting said head portions of said first and second guide members, said coil spring comprising means for urging said guide members apart and for urging said head portions into contact with said toggle member and said housing wall;

(e) wherein said base portion of said keeper comprises means for pivoting said toggle member from said first position to said second position upon the closing of said latch;

(f) wherein said dog projection of said keeper comprises means for pivoting said toggle member from said second position to said first position upon the opening of said latch; and (g) wherein said dog projection of said keeper is disposed between said toggle member and said retaining means when said latch is in a closed position, and (h) a switch operable between a closed position and an open position wherein a circuit is closed only when said toggle means is in said second position and the circuit is open only when said toggle means is in said first position, said switch being inoperable until said keeper means is fully inserted into said housing;

whereby the latch contains the switch requiring the latch to be in the latched position to complete the circuit such that accidental closing of the circuit is avoided.

4. The over-center toggle latch of claim 3, wherein the switch has a conductor extending through a portion of the keeper that mates with contacts in the housing to close the switch circuit.

5. For an over-center toggle latch for securing two members together having a latch housing affixed to one member, a keeper affixed to the other of the members, a toggle mounted within the housing for pivotal movement between a first position and a second position, a retaining means disposed within the housing and in pivotal contact with the housing and the toggle for retaining the toggle in either of the first and second positions, the keeper having means for pivoting the toggle from the first position to the second position upon closing of the latch, the keeper also providing means for pivoting the toggle from the second position to the first position upon opening of the latch, an improvement comprising a switch operable between a closed and open position wherein a circuit is closed only when the toggle is in the second position and the circuit is open only when the toggle is in the first position, the switch being inoperable until the keeper is fully inserted into the housing.

6. The over-center toggle latch of claim 5, wherein the switch has a conductor extending through a portion of the keeper that mates with contacts in the housing to close the switch circuit.

* * * * *